US007800583B2

(12) United States Patent
Kato

(10) Patent No.: US 7,800,583 B2
(45) Date of Patent: Sep. 21, 2010

(54) SLIDE OPERATION APPARATUS

(75) Inventor: Kojiro Kato, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 910 days.

(21) Appl. No.: 11/698,465

(22) Filed: Jan. 25, 2007

(65) Prior Publication Data

US 2007/0182712 A1 Aug. 9, 2007

(30) Foreign Application Priority Data

Feb. 3, 2006 (JP) ..... 2006-027060

(51) Int. Cl.
*G09G 5/00* (2006.01)

(52) U.S. Cl. ..... 345/157; 345/160; 345/184

(58) Field of Classification Search ..... 345/156, 345/157, 160, 161, 163, 184; 200/6 A, 252, 200/329; 341/20, 32, 35; 338/68, 74, 160
See application file for complete search history.

(56) References Cited

U.S. PATENT DOCUMENTS 5,327,162 A * 7/1994 Soma ..... 345/161
5,790,108 A * 8/1998 Salcudean et al. ..... 345/184
2001/0007449 A1* 7/2001 Kobachi et al. ..... 345/156

FOREIGN PATENT DOCUMENTS

JP 2002-008907 1/2002
JP 3102188 U 3/2004

* cited by examiner

*Primary Examiner*—Regina Liang
(74) *Attorney, Agent, or Firm*—Morrison & Foerster LLP

(57) ABSTRACT

A slide operation apparatus capable of preventing damages to a movement guide for slidably supporting a movable member, without increasing the weight and length thereof. The movable member (70) is disposed for sliding motion relative to guide bars (78, 79). Usually, a protrusion (70*a*) of the movable member is apart from a bottom portion (11) of a casing (10) with a spacing, and engaging protrusions (76, 77) of the movable member is apart from a rail portion (18) of the casing with a spacing. When the movable member is displaced by being applied with a force in a direction different from a direction in which the guide bars extend, an excessive displacement of the movable member is restricted by the contact between the protrusion and the bottom plate portion or between the rail portion and the engaging protrusions.

12 Claims, 7 Drawing Sheets

SLIDE OPERATION APPARATUS

BACKGROUND OF THE INVENTION

1. Field of the Invention

The present invention relates to a slide operation apparatus having a box in which a movable member is caused to move for parameter settings in response to an operation knob being operated.

2. Description of the Related Art

A slide operation apparatus such as a fader device mounted on a mixer or the like has conventionally been known (refer to Japanese Utility Model Registration Publication No. 3102188 and Japanese Patent Laid-open Publication No. 2002-008907). Generally, a slide operation apparatus includes a movable member caused to move in a box. For example, the movable member is adapted to be moved by manual operation of an operation knob, which is fixed to the movable member. A moving position of the movable member is detected, and based on the detected movable member position, parameter settings such as volume adjustment are carried out.

Generally, a movement guide formed by a rod circular in cross section is disposed in the box in the longitudinal direction, and the movable member is slidably engaged with the movement guide for movement in the longitudinal direction of the box by being guided by the movement guide.

In the aforesaid conventional slide operation apparatus, no substantial problem is caused as long as a force exerting only in the longitudinal direction of the movement guide is applied to the operation knob. In actual, however, a force is sometimes applied to the box in a direction perpendicular to the longitudinal direction of the movement guide (i.e., in the direction of pressing the operation knob downward or in the width direction of the box). In such a case, damages to the movement guide might be caused. To obviate this, the movement guide is made strong. Specifically, the movement guide is usually made thick and heavy, which poses a problem that the slide operation apparatus becomes large in weight and length.

Besides, the movement guide and the movable member are normally designed for very smooth sliding motion. Therefore, even when applying the operation knob with a large force exerting in the direction perpendicular to the longitudinal direction of the movement guide, a human operator is not aware of applying such force and can apply a much larger force to the operation knob. In addition, someone's hand or something can be in contact with the operation knob to inadvertently apply an excessive force thereto, posing a problem that the movement guide can be damaged.

SUMMARY OF THE INVENTION

An object of the present invention is to provide a slide operation apparatus capable of preventing damages to a movement guide for slidably supporting a movable member, without increasing the weight and length of the slide operation apparatus.

To attain the object, according to the present invention, there is provided a slide operation apparatus comprising a box (10, 40), a movable member holding device having at least one elongated movement guide (78, 79) provided in the box in a longitudinal direction of the box and guide supporting portions (20-23) that support opposite ends of the movement guide, a movable member (70) disposed in the box and slidably held by the movement guide of the movable member holding device, a position detecting device (73) that detects a position of the movable member along the movement guide of the movable member holding device in the box, an operation knob member (80) having an operation knob (81) and fixed to the movable member, and at least one stopper (11, 18) fixed to the box and disposed close to at least one predetermined portion (70*a*, 76, 77) of the movable member with a predetermined spacing when the operation knob is not operated, wherein when a force is applied to the operation knob in a direction different from a direction in which the movement guide extends, the predetermined portion of the movable member is displaced so as to be in contact with the stopper, when the predetermined portion of the movable member is in contact with the stopper, displacement of the predetermined portion is restricted, and when the force applied to the operation knob in the direction different from the direction in which the movement guide extends is released, a spacing between the predetermined portion and the stopper is restored to the predetermined spacing produced when the operation knob is not operated.

It should be noted that reference numerals in parentheses in the just-mentioned description simply indicate examples of structural elements of the slide operation apparatus and are not intended to limit the construction thereof or the like (ditto in the following).

According to the present invention, it is possible to restrict a displacement of the movable member when a force is applied thereto in a direction other than the direction in which the movement guide extends, making it possible to prevent damages to the movement guide without increasing the weight and length of the side operation apparatus.

Preferably, the movable member holding device holds the movable member so as to be displaceable in the direction different from the direction in which the movement guide extends, using elastic deformation of the movement guide, or using the guide supporting portions that are designed to permit displacement of the opposite ends of the movement guide.

With this preferred embodiment, a displacement of the movable member caused in substantially the same direction as the direction in which a force is applied to the operation knob can be restricted to permit displacement appropriate amount, making it possible to prevent damages to the movement guide.

Preferably, the movable member holding device holds the movable member (70) so as to be pivotably displaceable in a plane perpendicular to the direction in which the movement guide (78, 79) extends, and the stopper restricts a pivotal displacement of the predetermined portion of the movable member.

With this preferred embodiment, pivotal displacement of the movable member can be effectively restricted to an appropriate amount, thereby preventing damages to the movement guide.

Preferably, at least one of the predetermined portion (70*a*, 76, 77) of the movable member and the stopper (11, 18) is provided with a resistance generating member (91-94) that generates sliding resistance therebetween.

With this preferred embodiment, it is possible to generate a sliding resistance between the movable member and the stopper when a human operator applies an excessive operating force in a direction other than the direction in which the movement guide extends, thereby positively changing the feeling of operation to cause the operator to recognize that an excessive force is applied.

Preferably, the predetermined portion of the movable member and the stopper can be in face-contact with each other, and when the movable member is moved along the movement guide in a face-contact state therewith, friction is produced between the predetermined portion of the movable member and the stopper.

With this preferred embodiment in which the predetermined portion of the movable member and the stopper are made in face-contact with each other, forces applied to the predetermined portion and the stopper are dispersed whereby wear and damage thereof can be suppressed. When a human operator applies an excessive force in a direction other than the direction in which the movement guide extends, a friction is produced between the predetermined part of the movable member and the stopper to cause the feeling of operation to change, making it possible to cause the human operator to recognize that the operating force exerted by the operator is excessive.

Preferably, the movement guide (78, 79) is flexured when applied with a force in the direction different from the direction in which the movement guide extends, and flexure of the movement guide is restored when the force is released.

With this preferred embodiment, by virtue of flexure of the movement guide, the predetermined part of the movable member held by the movement guide is brought in contact with the stopper, whereby a displacement of the movable member can be restricted.

Preferably, the movement guide (78, 79) has a magnetic pole surface (88) thereof multipole magnetized in a longitudinal direction of the movement guide, and the position detecting device has a magnetic detecting portion (73) thereof fixed to the movable member so as to face the magnetic pole surface of the movement guide.

With this preferred embodiment, the moving position of the movable member along the movement guide can be detected using a simple construction.

Preferably, when a load ranging from several kilograms to ten kilograms is applied to the movable member (70) in a vertical direction of the box through the operation knob, the movement guide (78, 79) that holds the movable member is so deformed that the predetermined portion (70*a*, 76, 77) of the movable member is brought in contact with the stopper.

With this preferred embodiment, it is possible to restrict a displacement of the movable member caused by a vertical load, which ranges from several kilograms to ten kilograms, being applied to the movable member.

Preferably, the slide operation apparatus is used as a fader device, the predetermined portion (70*a*, 76, 77) of the movable member has first and second engagement portions (76, 77) apart from each other in a width direction perpendicular to the longitudinal direction and a vertical direction of the box, the stopper is made of part of a housing, which constitutes the box, of the fader device and loosely fitted between the first and second engagement portions of the movable member, and when being in contact with at least one of the first and second engagement portions, the stopper restricts movement of the movable member in the width direction of the box.

With the preferred embodiment in which the stopper is constituted by part of the housing, the resultant construction is simple, thus making it possible to suppress occurrences of failure. Since the stopper is loosely fitted between the two engagement portions of the movable member that are apart from each other in the width direction of the box, it is possible to restrict a displacement of the movable member in the width direction of the box, which is caused by a force applied to the movable member via the operation knob.

Preferably, the operation knob member (80) includes a first portion (82) thereof extending from the operation knob toward the movement guide in a vertical direction of the box (10, 40), a second portion (83) thereof extending from an end of the first portion in a width direction perpendicular to the longitudinal and vertical directions of the box, and a third portion (84) thereof extending from an end of the second portion toward the predetermined portion (70*a*, 76, 77) of the movable member in the vertical direction of the box, and the operation knob member has flexibility and is formed into a crank shape.

With this preferred embodiment in which the operation knob member has flexibility, it is possible to reduce the increase in reaction force from the stopper caused by the contact between the operation knob member and the predetermined portion of the movable member. Further, a force applied to the operation knob can be transmitted through the operation knob member to the predetermined portion of the movable member, and therefore, it is possible to restrict a displacement of the movable member when an excessive force is applied to the operation knob.

Preferably, the stopper extends parallel to the movement guide.

With this preferred embodiment, it is possible to restrict a displacement of the movable member caused by being applied with a force in a direction different from the direction in which the movement guide extends, irrespective of the moving position of the movable member.

Further features of the present invention will become apparent from the following description of exemplary embodiments with reference to the attached drawings.

DETAILED DESCRIPTION OF THE PREFERRED EMBODIMENTS

The present invention will now be described in detail below with reference to the drawings showing preferred embodiments thereof.

First Embodiment

Figure 1:
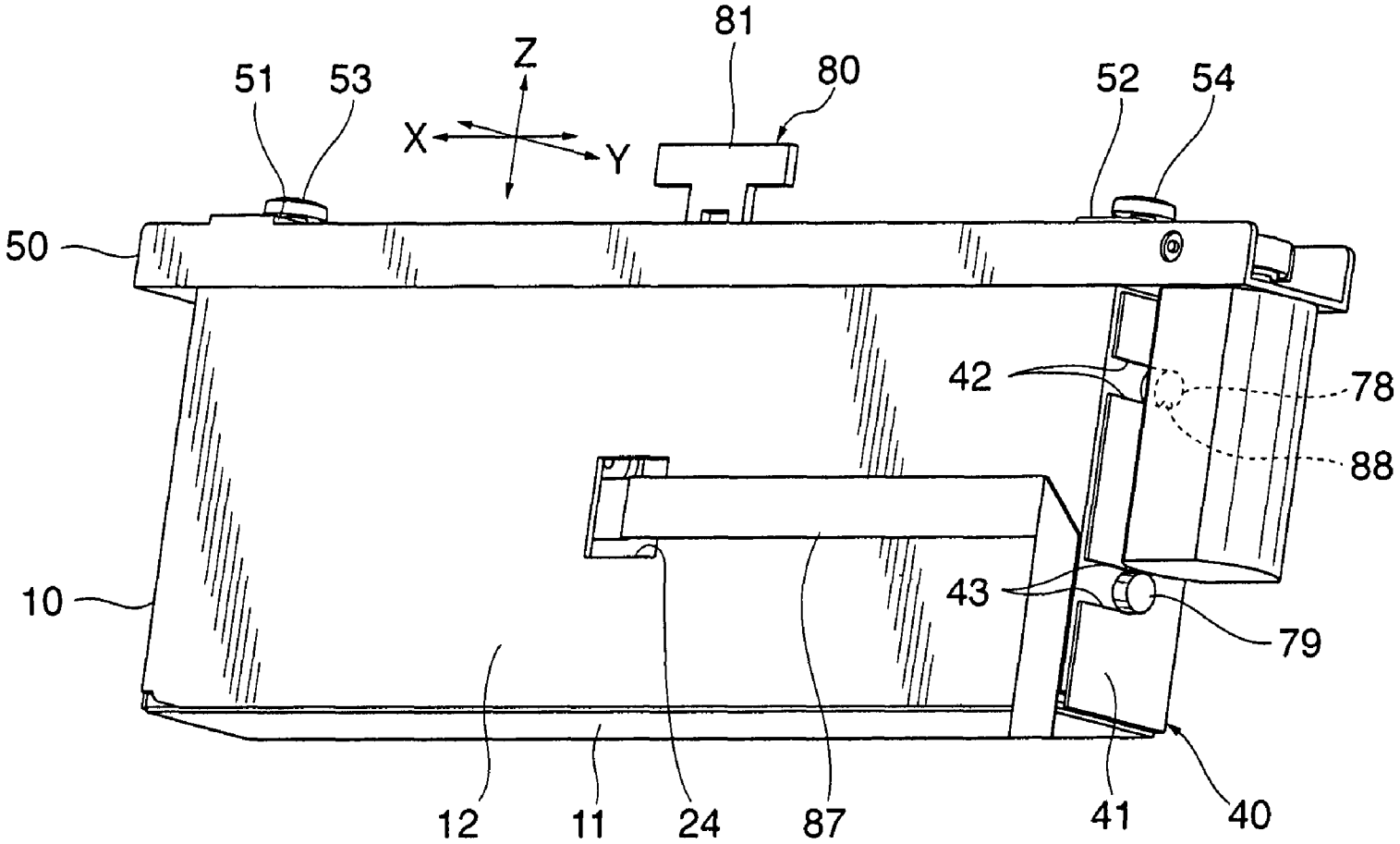
FIG. 1 is a perspective view showing a slide operation apparatus according to a first embodiment of the present invention.
Figure 2:
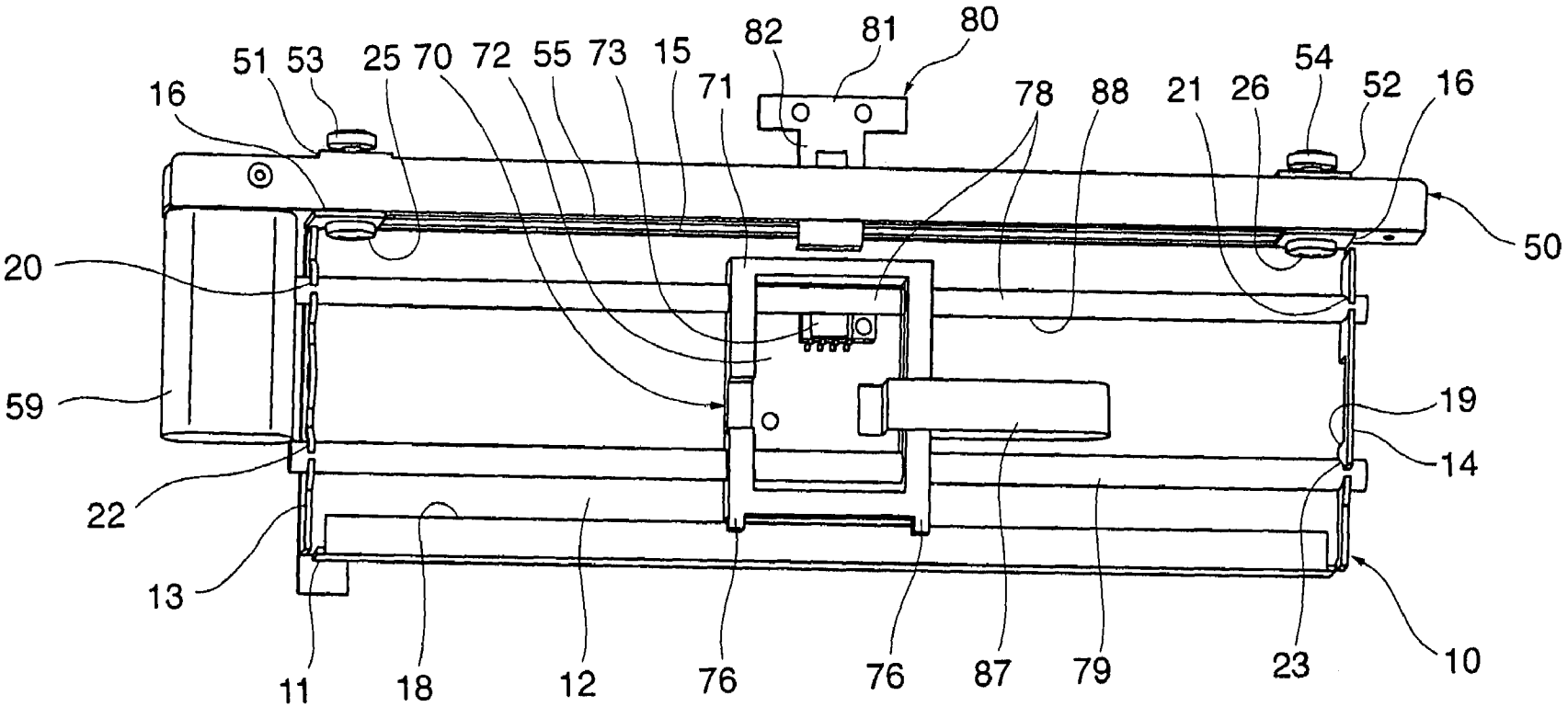
FIG. 2 is a perspective view showing the slide operation apparatus with a subsidiary casing detached therefrom.

FIG. 1 is a perspective view showing a slide operation apparatus according to a first embodiment of the present invention. The slide operation apparatus has a box or housing comprised of a main casing 10 and a subsidiary casing 40 that are assembled together. FIG. 2 is a perspective view showing the slide operation apparatus in a state where the subsidiary casing 40 is detached therefrom, FIG. 3A is a perspective view of the main casing 10, FIG. 3B is a perspective view of a movable member, and FIG. 4 is a plan view of the slide operation apparatus.

As shown in FIG. 2, in the box of the slide operation apparatus, a movable member 70 is housed together with upper and lower guide bars 78, 79 each of which is formed by a round bar. The main casing 10 has an upper part thereof provided with an elongated member 50 which is a U shape in cross section. A motor 59 is disposed on one end side of the elongated member 50.

The slide operation apparatus is designed as a fader device, for example, which is adapted to be installed on a mixer or the like in an arbitrary orientation. In the following, it is assumed that upward, downward, leftward and rightward directions are determined as viewed from the side of the subsidiary casing 40 with an operation knob 81 of an operation knob member 80 disposed upward. Specifically, the upward, leftward, and frontward directions are directions directed toward the operation knob 81, a motor 59 (refer to FIG. 2), and the front side of FIG. 2, respectively.

Figure 3A:
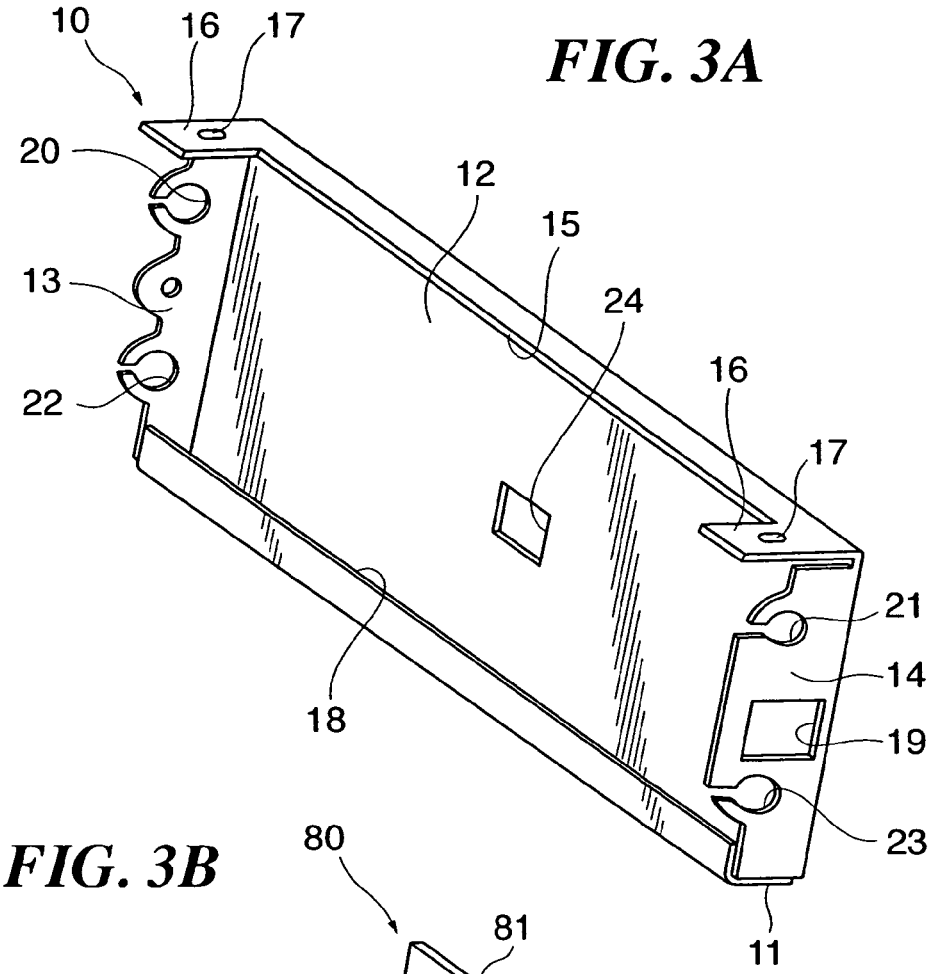
FIG. 3A is a perspective view of a main casing.
Figure 3B:
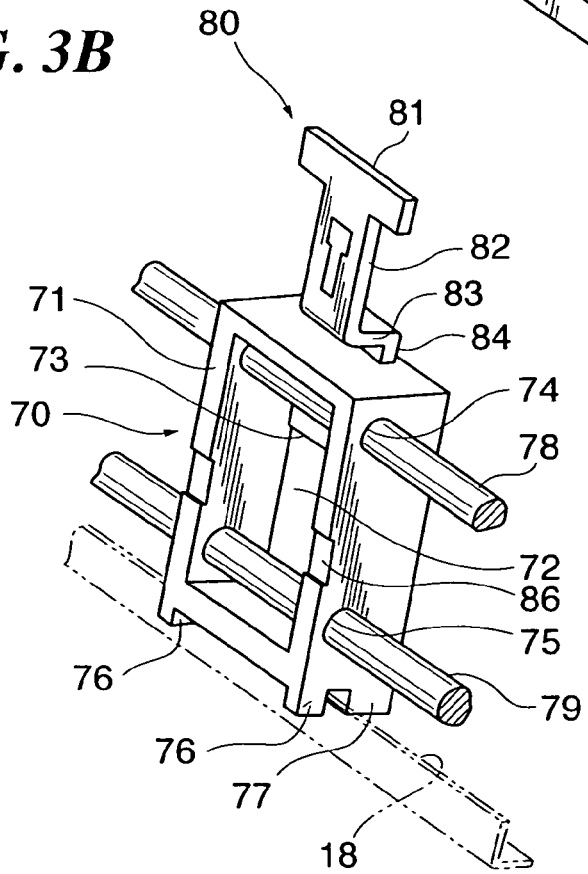
FIG. 3B is a perspective view showing a movable member.
Figure 4:
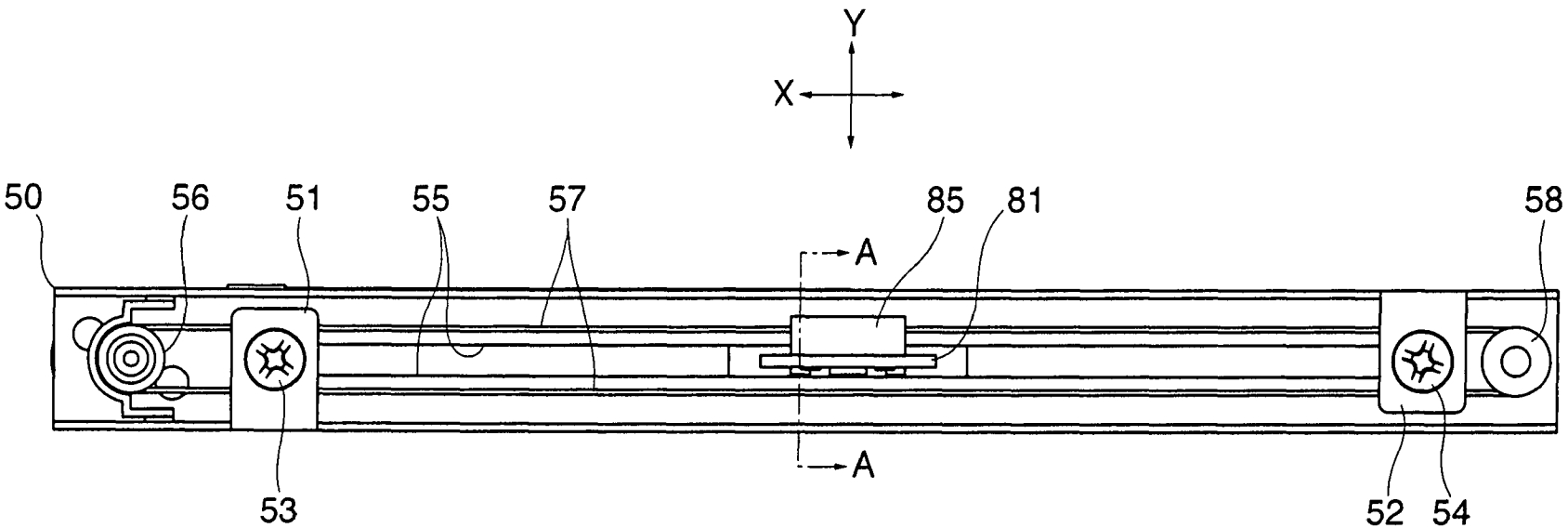
FIG. 4 is a plan view showing the slide operation apparatus.

As shown in FIGS. 2 and 3A, the main casing 10 is comprised of a bottom plate 11, a main plate 12 disposed on the rear surface side of the main casing 10, a left side plate 13, a right side plate 14, an upper plate 15, and a rail portion extending upward from a front part of the bottom plate 11. The upper plate 15 has right and left end portions thereof extending forwardly to form mounting pieces 16, which are used for mounting the elongated member 50 thereon. The main casing 10, which is formed into one piece, is fabricated by bending a metal sheet. The mounting pieces 16 are each formed with a mounting hole 17 (refer to FIG. 3A).

The left and right plates 13, 14 of the main casing 10 are respectively formed with upper holding holes 20, 21 used for holding the upper guide bar 78 and lower holding holes 22, 23 used for holding the lower guide bar 79. The right side plate 14 is formed with a through hole 19 provided between the holding holes 21 and 23. As shown in FIGS. 1 and 3A, the main plate 12 is formed with a cable insertion hole 24 at a location corresponding to a longitudinally center part of the main casing 10.

As shown in FIG. 2, the elongated member 50 is fixed to the main casing 10 by means of screws 25, 26 passing through the mounting holes 17 (refer to FIG. 3A) of the mounting pieces 16 of the main casing 10. As shown in FIGS. 2 and 4, the elongated member 50 has a bottom portion thereof longitudinally formed with a slit along which the operation knob member 80 is moved. Mounting pieces 51, 52 are provided in upper parts of left and right end portions of the elongated member 50. The slide operation apparatus having been assembled is mounted to a mixer or the like, not shown, by fastening the mounting pieces 51, 52 to a panel or the like of the mixer using screws 53, 54.

As shown in FIG. 4, a pulley 56 is disposed on an upper face of the left end portion of the elongated member 50, and mounted to an output shaft, not shown, of the motor 59 extending through the elongated member 50. A belt receiving pin 58 is provided on an upper face of a right end portion of the elongated member 50, and a rubber belt 57 is wound and stretched between the pulley 56 and the belt receiving pin 58. The rubber belt 57 is fixed at one point to a belt mounting portion 85, which is in turn fixed to the operation knob member 80. With forward and reverse rotations of the motor 59, the operation knob 81 is reciprocated (together with the movable member 70) by the rubber belt 57 in the longitudinal direction of the elongated member 50. At the time of scene recall, for instance, a driving current is caused to flow through the motor 59, whereby the movable member 70 is automatically driven to a desired position. Besides, a user can move the movable member 70 to an arbitrary position by manually operating the operation knob 81. The operation knob 81 may be provided with a grasp portion made of rubber or the like. In that case, the user grasps the grasp portion when operating the operation knob.

Figure 5:
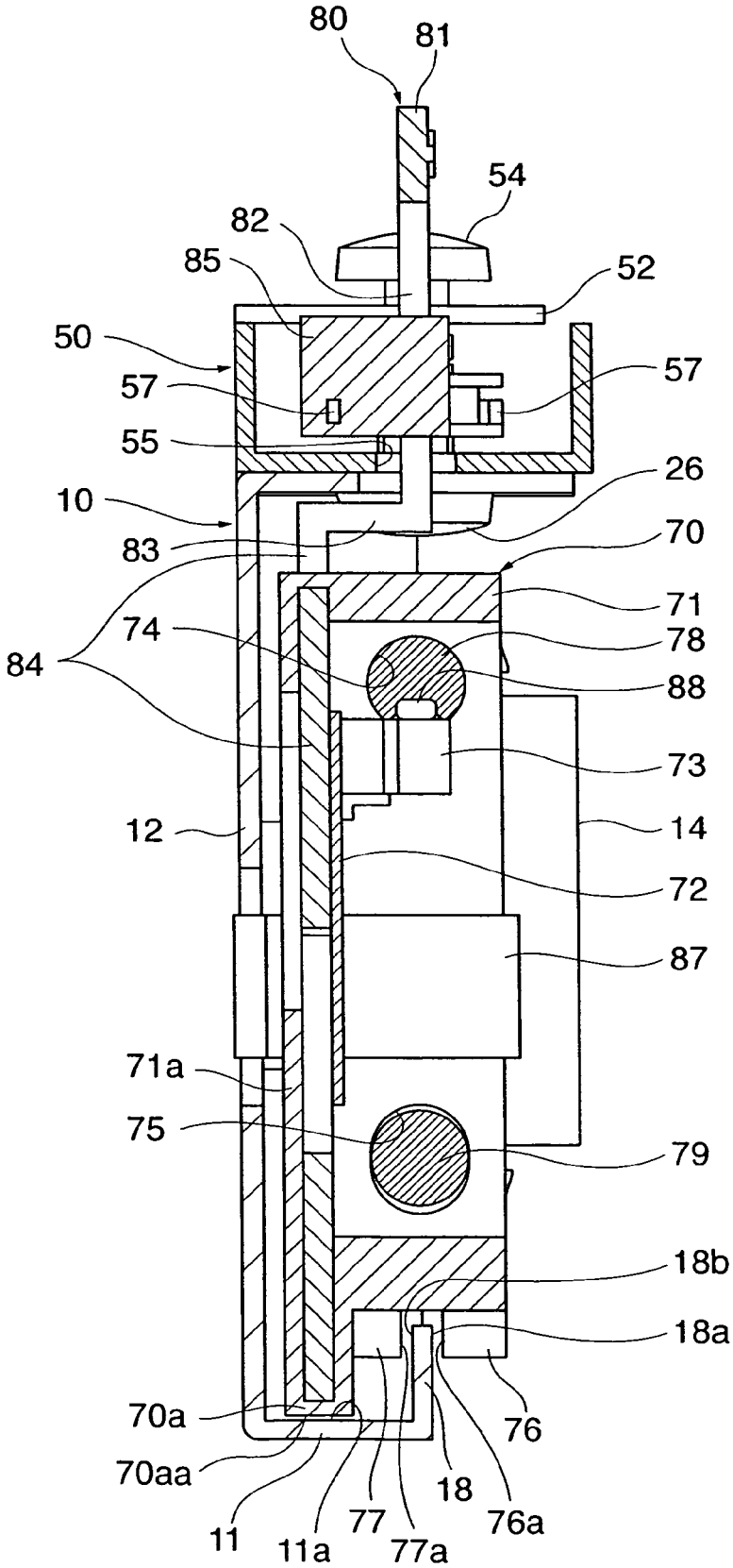
FIG. 5 is a section view taken along line A-A in FIG. 4.

FIG. 5 is a section view taken along line A-A in FIG. 4. As shown in FIGS. 2, 3B, and 5, the movable member 70 includes a gondola 71 made of resin. The gondola 71 is formed into a rectangular box having an open front side, and the operation knob member 80 is fixed to the gondola 71. A cable escape portion 86 is formed at a front edge portion of a right side wall of the gondola 71 (refer to FIG. 3B). Through holes 74, 75 are respectively formed in left and light side walls of the gondola 71. The upper guide bar 78 is inserted through the through hole 74, whereas the lower guide bar 79 is inserted through the through hole 75. As a result, the gondola 71 is made slidable relative to the upper and lower guide bars 78, 79.

Further, a board 72 is attached to the movable member 70, and a flat cable 87 is connected at its one end with the board 72 (refer to FIGS. 2 and 5). The flat cable 87 passes through the cable escape portion 86 of the gondola 71 and extends into the main casing 10. The flat cable 87 is disposed in the main casing 10 and extends therein for a length long enough to be capable of following a motion of the movable member 70, and is drawn out to the outside through the cable insertion hole 24 of the main casing 10 (refer to FIGS. 1 and 3A).

As shown in FIG. 5, the upper guide bar 78 has a lower surface thereof formed with a magnetic pole surface 88 over substantially the entire longitudinal length of the upper guide bar 78. The magnetic pole surface 88 is multipole magnetized at equal intervals in the longitudinal direction. That is, the magnetic pole surface 88 is alternately magnetized into N and S poles. The lower surface of the magnetic pole surface 88, i.e., the lower surface of the upper guide bar 78 is formed into a flat surface. The hole 74 of the gondola 71 is formed into a circular shape corresponding to a circular cross section of the upper guide bar 78. The upper guide bar 78 is closely fitted into the hole 74 of the gondola 71, so that the gondola 71 may be restricted in position by the upper guide bar 78 in both the vertical and front-to-back directions. In other words, a moving path of the gondola 71 is restricted by the upper guide bar 78. As a result, a stable movement of the movable member 70 is ensured, and therefore, the accuracy in detecting the position of the movable member 70 is improved.

In contrast, the hole 75 formed in the gondola 71 is slightly elongated. Thus, the lower guide bar 79 can absorb a fabrication error, and subsidiarily serves to restrict the moving position of the movable member 70. In particular, the lower guide bar 79 has a function of preventing a swing motion of the movable member 70 around the upper guide bar 78.

As shown in FIGS. 2, 3B, and 5, a magnetic sensor portion 73 (or an MR sensor) comprised, for example, of an IC that includes a Hall element is disposed in a front surface of the board 72. At a location immediately below the upper guide bar 78, the sensor portion 73 faces the magnetic pole surface 88 of the upper guide bar 78 with a narrow gap (spacing) therebetween.

When the sensor portion 73 is moved relative to the magnetic pole surface 88 of the upper guide bar 78 with movement of the movable member 70, the sensor portion 73 outputs a pulse signal each time a boundary between adjacent N and S poles of the magnetic pole portion passes through the sensor portion 73. Based on the number of pulse signals, an amount of movement of the movable member 70 can be detected. The magnetic poles of the magnetic pole surface 88 are arranged in two columns, for instance, and these magnetic pole columns are out of phase from each other by ½π in the longitudinal direction of the upper guide bar 78. With movement of the movable member 70, therefore, the sensor portion 73 outputs two pulse signal trains that are out of phase with each other. Based on whether the phase shift between the pulse signal trains occurs in the normal or reverse direction, the moving direction, to the right or left, of the movable member 70 is detected. Moreover, information on the position of the movable member 70 before being moved is always stored in a controller circuit, not shown. The current position of the movable member 70 is detected based on the information on the previous position of the movable member 70 as well as the detected amount and direction of movement of the movable member 70. Also at the time of manual operation, the operation of moving the movable member 70 is detected by the sensor portion 73.

As shown in FIG. 2, the upper and lower guide bars 78 and 79 inserted through the through holes of the gondola 71 are held by their opposite end portions being inserted into the holding holes 20 to 23 formed in the main casing 10, with the upper guide bar 78 circumferentially positioned such that the magnetic pole surface 88 is directed downward.

The subsidiary casing 40 made of resin is formed into a U-shape as viewed in plan. The subsidiary casing 40 is assembled to the main casing 10 by a snap fit engagement between engagement portions, not shown, of the subsidiary casing 40 and the main casing 10.

As shown in FIG. 1, the subsidiary casing 40 has a right side plate 41 thereof formed with notches 42, 43 respectively corresponding to the upper and lower guide bars 78, 79. Although a left side plate of the subsidiary casing 40 is not illustrated, it is constructed symmetrical to the right side plate 41. The notch 43 has its width nearly equal to an outer diameter of the lower guide bar 79. The notch 42 has a width nearly equal to a vertical thickness of the upper guide bar 78 having the magnetic pole surface 88 directed downward (i.e., nearly equal to a distance between an upper end of the upper guide bar and the lower surface of the magnetic pole surface 88). As a result, the notch 42 of the subsidiary casing 40 having been assembled to the main casing 10 restricts the rotational position of the upper guide bar 78 having the magnetic pole surface 88 thereof directed downward (rotation preventing function). It should be noted that the mechanism for preventing rotation around the upper guide bar 78 may be provided in any member other than the subsidiary casing 40. For example, the hole 74 of the gondola 71 or the holding holes 20, 21 of the main casing 10 may be formed into a shape equal to the cross sectional shape of the upper guide bar 78 (which is circular with a lower flat part).

The upper and lower guide bars 78, 79 are each made of a resilient metal, and flexured when a force is applied to the movable member 70 in a direction other than the longitudinal direction of the upper guide bar 78. As a result, the movable member 70 can be displaced. When such force is released, the flexure state of the upper and lower guide bars 78, 79 is removed.

As shown in FIG. 5, the operation knob member 80 includes a first vertical portion 82 extending downward from an upper portion or the operation knob 81, a horizontal portion 83 extending horizontally from a lower end of the first vertical portion 82 to the rear side, and a second vertical portion 84 extending downward from a rear end of the horizontal portion 83, these three portions being formed into one piece. The operation knob member 80 made of metal is fixed to the gondola 71 by means of outsert molding, adhesion, fitting, or the like. The second vertical portion 84 is extended in position to a lower protrusion 70*a* of the movable member 70, i.e., a rear lower end portion of the gondola 71, along the rear plate 71*a* of the gondola 71. The aforesaid belt mounting portion 85 is attached to the first vertical portion 82.

The lower protrusion 70*a* is formed to extend over the entire width of the gondola 71 (the longitudinal width of the upper guide bar 78) and has a lower end surface 70*aa* thereof disposed closely to and facing an upper surface 11*a* of the bottom plate 11 of the main casing 10. The lower end face 70*aa* and the upper surface 11*a* are formed into flat in their entirety and extend horizontally. Irrespective of the moving position of the movable member 70, in a non-operation state where the human operator does not touch the operation knob 81, the upper and lower guide bars 78, 79 are not flexured, and the lower end surface 70*aa* and the upper surface 11*a* are kept apart at a predetermined spacing. When a force of a predetermined magnitude or more is applied downward to the operation knob member 80, the lower end surface 70*aa* is brought in contact with the upper surface 11*a*, whereby a stopper function is achieved of suppressing a further downward displacement of the movable member 70.

The second vertical portion 84 is located at a central part of the lower protrusion 70*a* as viewed in the front-to-back direction, and therefore, a downward force applied to the operation knob member 80 can directly be applied to the lower protrusion 70*a*. As a result, the lower end surface 70*aa* can effectively receive an excessive downward force applied to the operation knob member 80.

The bottom plate 11 and the rail portion 18 are extended over substantially the entire length of the main casing 10 so as to cover a range in which the movable member 70 can move (refer to FIG. 2). The rail portion 18 has a front surface 18*a* and a rear surface 18*b* thereof each formed into a vertical flat surface that extends parallel to the upper and lower guide bars 78, 79 when the operation knob 81 is in a non-operation state.

As shown in FIGS. 2, 3B and 5, a pair of front engaging protrusions 76 and a pair of rear engaging protrusions 77 are provided at respective ones of four corners of a lower end portion of the gondola 71. As shown in FIG. 5, the rail portion 18 is loosely fitted into a recess defined between the paired front and rear engaging protrusions 76 and 77. Irrespective of the moving position of the movable member 70, when the operation knob 81 is in the non-operation state, a rear surface 76*a* of the engaging protrusion 76 and a front surface 18*a* of the rail portion 18 are disposed close to and face each other with a predetermined spacing, and a front surface 77*a* of the engaging protrusion 77 and a rear surface 18*b* of the rail portion 18 are also disposed close to and face each other with a predetermined spacing. Similarly, the front and rear surfaces 77*a*, 76*a* are formed into a flat vertical surface over the entirety thereof.

The rear and front surfaces 76*a*, 18*a* and the front and rear surfaces 77*a*, 18*b* when brought in contact with each other restrict an excessive displacement of the engaging protrusions 76 and 77, i.e., a lower part of the movable member 70 in the front-to-back direction of the slide operation apparatus (explained in detail below with reference to FIGS. 6A through 6C). Thus, the rail portion 18 also achieves a stopper function against an excessive force applied to the movable member 70.

Figure 6A:
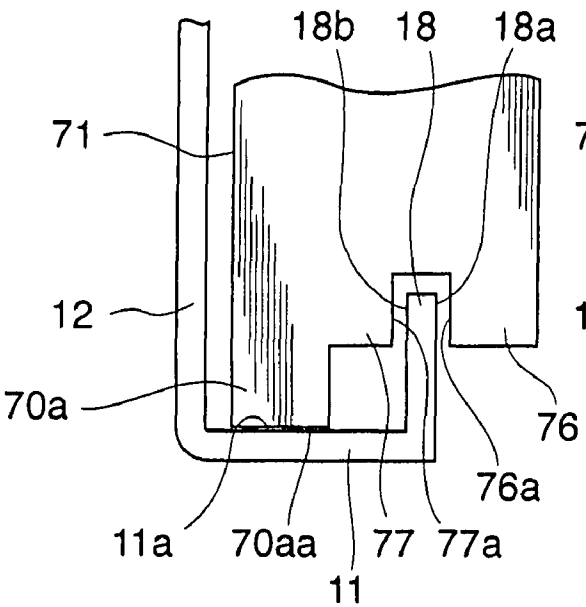
FIG. 6A is a fragmentary section view of the slide operation apparatus, which shows how a motion of the movable member is restricted when an excessive downward force is applied to an operation knob member.
Figure 6B:
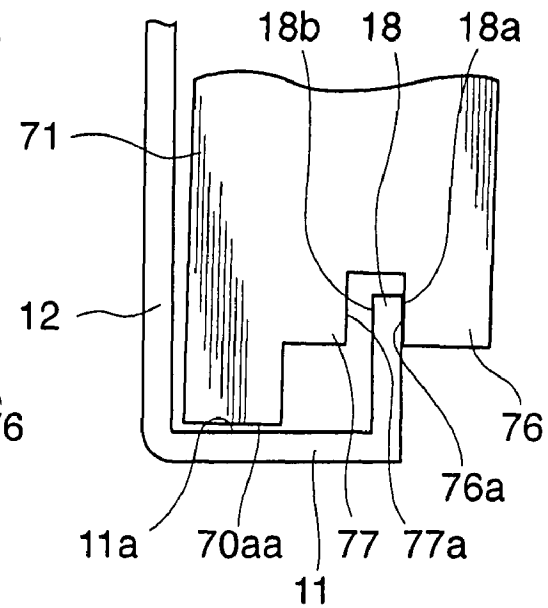
FIG. 6B is a fragmentary view showing the restriction of a motion of the movable member when a clockwise rotational moment is applied to the movable member.
Figure 6C:
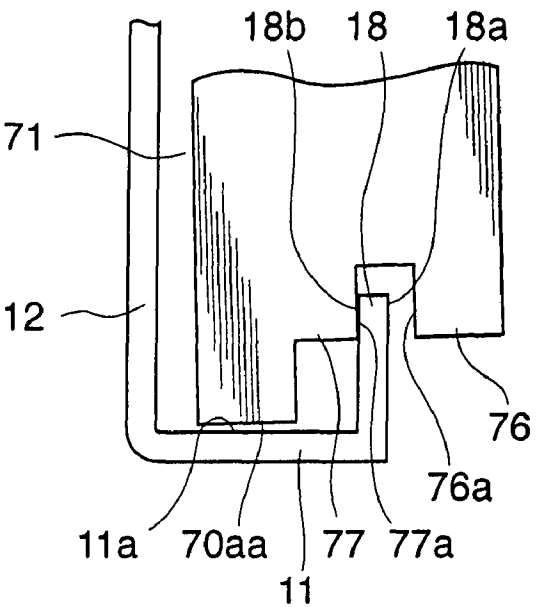
FIG. 6C is a fragmentary view showing the restriction of a motion of the movable member when a counterclockwise rotational moment is applied to the movable member.

FIGS. 6A through 6C are fragmentary section views of the slide operation apparatus schematically showing how a movement of the movable member 70 is restricted when an excessive force is applied to the operation knob member 80.

When the operation knob 81 is properly operated, an operation force mostly exerts in the longitudinal direction (X direction shown in FIGS. 1 and 4) of the upper guide bar 78. In that case, the lower protrusion 70*a* of the movable member 70 is not brought in contact with the bottom plate 11 of the main casing 10. Further, the engaging protrusions 76, 77 are not brought in contact with the rail portion 18. Thus, the movable member 70 is smoothly slid in the longitudinal direction of the upper guide bar 78 in response to the operation.

At the time of slide operation, if the operation knob 81 is pressed down with an excessive force, however, as shown in FIG. 6A, the lower end surface 70*aa* of the lower protrusion 70*a* is in sliding contact with the upper surface 11*a* of the bottom plate 11 as the movable member 70 is slidingly moved. As a result, an amount of downward motion of the movable member 70 is properly restricted. At this time, a friction is produced between the lower end surface of the lower protrusion and the upper surface of the bottom plate which are in sliding contact, and as a result, the human operator feels that the slide operation apparatus becomes heavier in operation. Thus, the human operator recognizes that the feeling of operating the operation knob 81 different from that experienced at the time of proper operation. When the human operator aware of that he or she improperly operates the operation knob decreases the downward force, the lower protrusion 70*a* is apart from the bottom plate 11, and a proper slide operation is restored.

It should be noted that when the movable member 70 is displaced downward, the lower protrusion 70*a* is first brought in contact with the bottom plate 11, and therefore, an upper end of the rail portion 18 never be in contact with a ceiling surface that defines the aforesaid recess formed between the engaging protrusions 76, 77.

When the operation knob member 80 is applied with a force in the front-to-back direction (the Y direction (width direction) shown in FIGS. 1 and 4), the entire movable member 70 is displaced in that direction. If such a force is applied at the time of slide operation, the rear surface 76*a* of the engaging protrusion 76 or the front surface 77*a* of the engaging protrusion 77 is brought in sliding contact with the rail portion 18 as the movable member 70 is in slide motion (refer to FIG. 5). In that case, the human operator experiences a heavier feeling in operation, which promotes decreasing the force in the Y direction, and as a result, a proper slide operation is restored.

However, the operation force applied to the operation knob member 80 may exert not only in the X direction, Y direction, or vertical direction (Z direction shown in FIG. 1) but also in a combined direction. Furthermore, the operation force may produce a rotational moment on the operation knob member 80 in a case, for example, where the human operator firmly grasps the operation knob member 80 when operating the same. In particular, when the knob member 80 is operated such as to be applied with a rotational moment around the X-direction axis, a rotational displacement (rolling) of the movable member 70 around the X-direction axis is caused, with a rotation center position varying depending on how the movable member is operated. Also in that case, an excessive displacement of the movable member 70 is restricted by sliding contact between the rail portion 18 and the engaging protrusions 76, 77.

In a case, for example, where a clockwise rotational moment around the X-direction axis is applied to the movable member 70 as a result of the operation knob member 80 being operated, as shown in FIG. 6B, the movable member 70 attempts to incline forwardly. In this case, the engaging protrusion 76 is brought in contact or sliding contact with the rail portion 18. Conversely, when a counterclockwise rotational moment is applied to the movable member 70, the engaging protrusion 77 is brought in contact or sliding contact with the rail portion 18 as shown in FIG. 6C. In either case, an amount of rotation of the movable member 70 is properly restricted.

In most cases, the contact between the lower protrusion 70*a* and the bottom plate 11 and between the rail portion 18 and the engaging protrusions 76, 77 is in the form of face-contact, and therefore, a stress produced in their surfaces is dispersed, thus suppressing wear and damage thereof. Moreover, the operation knob member 80 is bent into a crank shape, and has the horizontal portion 83 thereof extending between the first and second vertical portions 82 and 84 (refer to FIG. 5). For this reason, when the human operator increases a downward force even after the lower protrusions 70*a* is in contact with the bottom plate 11, the horizontal portion 83 is flexured so that the first vertical portion 82 may be displaced downward. As a result, the increase in reaction force from the bottom plate 11, which is produced by the contact between the lower protrusion 70*a* and the bottom plate 11, is slightly moderated. Even when an excessive force is abruptly applied, the operation knob member 80 absorbs at least part of the excessive force, making it possible to protect the movable member 70 from failure.

The upper and lower guide bars 78, 79 are flexured due to their elasticity upon contact between the lower protrusion 70*a* and the bottom plate 11 or between the rail portion 18 and the engaging protrusions 76, 77. In this regard, the predetermined spacings between the lower protrusion 70*a* and the bottom plate 11 and between the rail portion 18 and the engaging protrusions 76, 77 are set so that amounts of flexure of the guide bars fall within a range of elastic deformation and small enough that the breaking strain of the guide bars are not reached. The present embodiment is so designed that the lower protrusion 70*a* is brought in contact with the bottom plate 11 when a downward load ranging from several kilograms to ten kilograms is applied to the movable member 70.

According to the present embodiment, when the movable member 70 is displaced due to the operation knob 81 being applied with a force in a direction different from the direction in which the upper guide bar 78 extends, an excessive displacement of the movable member 70 is restricted by the contact between the lower protrusion 70*a* and the bottom plate 11 or between the rail portion 18 and the engaging protrusions 76, 77. In addition, the upper and lower guide bars 78, 79 that elastically hold the movable member 70 for movement are made thin in size and light in weight to permit the movable member 70 to be displaced in a direction different from the direction in which the upper guide bar 78 extends. Thus, the upper and lower guide bars 78, 79 are not needed to have an extremely high rigidity. This makes it possible to prevent the upper and lower guide bars 78, 79 from being damaged without the need of increasing the weight and length of the slide operation apparatus.

Besides, the bottom plate 11 and the rail portion 18 adapted to be in contact with the movable member 70 have their surfaces extending parallel to the upper guide bar 78, and as a result, they can achieve the stopper function for the movable member 70 at the time of an excessive force being applied, irrespective of the moving position of the slidingly moving movable member 70, and can change the operation feeling to permit the human operator to recognize that an excessive force is applied to the movable member.

In particular, when the operation knob member 80 is operated in such a manner that not only a force exerting in the X, Y, or Z direction is applied but also a rotational moment is applied, a rotational displacement of the movable member 70 can be restricted by the contact between the rail portion 18 and the engaging protrusions 76, 77. As a result, the slide operation apparatus can achieve the stopper function for the device that is operated variously, whereby the displacement of the movable member 70 can be suppressed up to an appropriate amount. In addition, since the engaging protrusions 76, 77 are located on a lower side opposite from the operation knob 81 with respect to the movable member 70, the rail portion 18 effectively exhibits adequate restriction on the rotational displacement of the movable member 70.

Furthermore, the bottom-plate 11 and the rail portion 18 are part of the main casing 10, and thus simple in construction, resulting in reduction in frequency of failure.

Second Embodiment

Figure 7A:
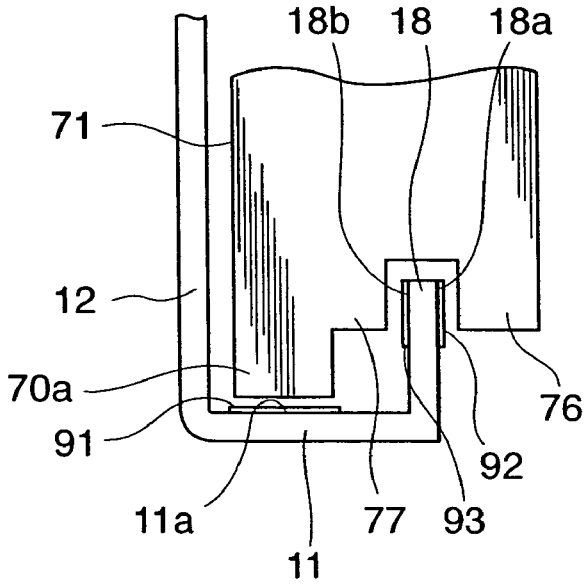
FIG. 7A is a fragmentary view, similar to FIG. 6A, showing a slide operation apparatus according to a second embodiment of the present invention.

FIG. 7A is a fragmentary view, similar to FIG. 6A, showing a slide operation apparatus according to a second embodiment of the present invention. The present embodiment differs from the first embodiment only in that a friction producing member is provided in the bottom plate 11 and the rail portion 18 of the main casing 10, and is the same in other constructions as the first embodiment.

As shown in FIG. 7A, the friction producing member 91 is provided or affixed to that portion of the upper surface 11*a* of the bottom plate 11 with which the lower protrusion 70*a* of the movable member 70 can be contacted. Friction producing members 92 and 93 are provided or affixed to those portions of the front and rear surfaces 18*a*, 18*b* of the rail portion 18 with which the engaging protrusions 76, 77 can be contacted. These friction producing members 91, 92 and 93 are sheet members which are large in surface roughness.

By virtue of the sliding contact between the lower protrusion 70*a* and the friction producing member 91 and between the engaging protrusions 76, 77 and the friction producing members 92, 93, a larger friction force is produced as compared to the first embodiment. Thus, a more distinct change can occur in the feeling of operating the operation knob 81. The present invention not only can achieve advantages similar to those attained by the first embodiment, but also can positively change the feeling of operation to thereby permit the human operator to recognize that an excessive operating force; if any, is applied to the slide operation apparatus.

It should be noted that the upper face 11*a* of the bottom plate 11 and the front surfaces 18*a*, 18*b* of the rail portion 18 may have a large surface roughness to produce enough friction, instead of or in combination with providing the friction producing members 91, 92 and 93.

It should be noted that in a case where a change in the feeling of operation, caused by an Z-direction operation among operations in various directions to the operation knob member 80, is to be mainly recognized, only the friction producing member 91 may have a large surface roughness, and instead of using the friction producing members 92 and 93, there may be used plate members that are the same in shape as but smoother in surface roughness than the friction producing members 92 and 93. These plate members suppress the operation knob member 80 from rattling in the X and Y directions, to ease a smooth operation.

Figure 7B:
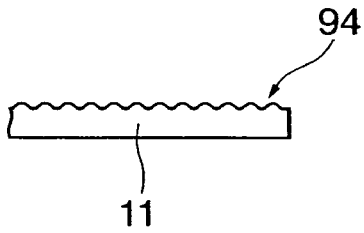
FIG. 7B is a view showing a modification of a friction generating part of the slide operation apparatus.

From the viewpoint of causing the feeling of operation to change, any resistance other than the friction force may be produced. For example, as shown in FIG. 7B, the upper surface of the bottom plate 11 may be formed into a wave-like corrugated surface 94 extending in the longitudinal direction of the upper guide bar 78. In that case, during the sliding motion of the movable member 70, when the lower protrusion 70*a* is brought in contact with the corrugated surface 94, the movable member 70 is caused to vibrate, and hence the feeling of operating the operation knob 81 becomes quite different from the ordinary operation feeling, whereby an inappropriate operation can be immediately recognized with ease.

It should be noted that the friction producing member may not be provided in the bottom plate 11 but may be provided in the lower protrusion 70*a*. Similarly, the friction producing member may not be provided in the rail portion 18 but may be provided in the engaging protrusions 76 and 77. Alternatively, the friction producing member may be provided in both opposed surfaces thereof. Further, the corrugated surface may be provided in the lower surface of the lower protrusion 70*a* or in both the bottom plate 11 and the lower protrusion 70*a*.

Figure 7C:
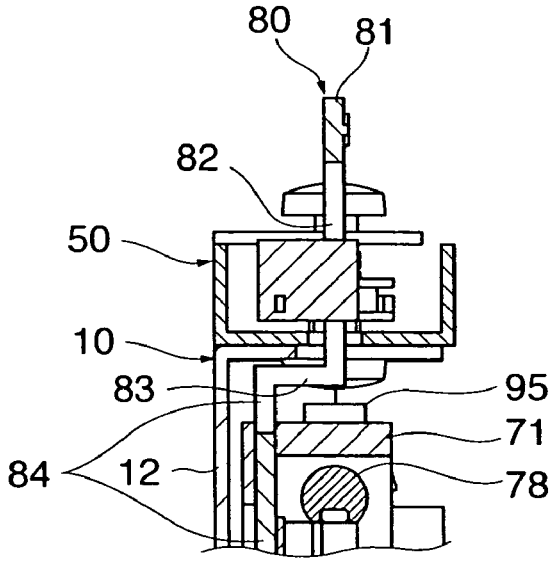
FIG. 7C is a fragmentary section view showing a modification of the movable member.

In the first and second embodiments, a stopper portion 95 may be provided in the gondola 71 of the movable member 70 for contact with the horizontal portion 83 of the operation knob unit 81, as shown in FIG. 7C. The horizontal portion 83 is brought in contact with the stopper portion 95, when a downward force applied to the operation knob 81 increases even if the lower protrusion 70*a* is in contact with the bottom plate 11, whereby the horizontal member 83 can be prevented from being damaged.

Instead of using the arrangement in which the lower protrusion 70*a* and the bottom plate 11 are first made in contact with each other when the movable member 70 is displaced downward, the downward displacement of the movable member 70 may be restricted by causing the ceiling surface of the recess formed between the engaging protrusions 76 and 77 to be in contact with the upper end of the rail portion 18. With this arrangement, both the stopper mechanisms for the movable member 70 in the downward and front-to-rear directions can be concentratedly provided in the recess formed between the engaging protrusions 76 and 77, thus making it possible to form the slide operation apparatus more compact in size.

Both the stopper mechanism using the lower protrusion 70*a* and the bottom plate 11 and the stopper mechanism using the ceiling surface of the recess formed between the engaging protrusions 76, 77 and the upper end of the rail portion 18 may be provided so that these stopper mechanisms nearly simultaneously operate. With this arrangement, the downward displacement of the movable member 70 can be restricted while maintaining a stable posture.

In the first and second embodiments, the upper and lower guide bars 78, 79 are fixedly held by the upper holding holes 20, 21 and the lower holding holes 22, 23, respectively, and the movable member 70 may be displaced in a direction other than the X direction (refer to FIG. 1) simply using the elasticity of the upper and lower guide bars 78, 79. This is not limitative. The mechanism for holding the upper and lower guide bars 78, 79 may comprise an elastically holding function or any other function that permit the upper and lower guide bars 78, 79 to be displaced in the Y or Z direction.

More specifically, from the viewpoint of preventing damages to the upper and lower guide bars 78, 79, the upper and lower guide bars 78, 79 and the holding mechanism therefor may be designed to form a "movable member holding device" that holds the movable member 70 for displacement. For example, the movable member 70 may be held for displacement in a direction other than the X direction, using elastic deformation of the upper and lower guide bars 78, 79 and/or the holding mechanism that permits displacements of opposite end portions of the upper and lower guide bars 78, 79.

Although not preferable from the viewpoint of achieving a stable sliding motion of the movable member 70, the lower guide bar 79 may be removed so long as the movable member 70 is prevented from rotating around the upper guide bar 78 using the upper guide bar 78 which is rectangular in cross section, for instance.

It should be noted that the slide operation apparatus is not only applicable to a fader device of a mixer but also applicable to a drawbar used for tone color setting of an organ, or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A slide operation apparatus comprising:

a box;

a movable member holding device having at least one elongated movement guide provided in said box in a longitudinal direction of the box and guide supporting portions that support opposite ends of the movement guide;

a movable member disposed in said box and slidably held by the movement guide of said movable member holding device;

a position detecting device that detects a position of said movable member along the movement guide of said movable member holding device in said box;

an operation knob member having an operation knob and fixed to said movable member; and at least one stopper fixed to said box and disposed close to at least one predetermined portion of the movable member with a predetermined spacing when said operation knob is not operated, wherein when a force is applied to said operation knob in a direction different from a direction in which the movement guide extends, the predetermined portion of the movable member is displaced so as to be in contact with said stopper, when the predetermined portion of the movable member is in contact with said stopper, displacement of the predetermined portion is restricted, and when the force applied to said operation knob in the direction different from the direction in which the movement guide extends is released, a spacing between the predetermined portion and said stopper is restored to the predetermined spacing produced when said operation knob is not operated.

2. The slide operation apparatus according to claim 1, wherein said movable member holding device holds the movable member so as to be displaceable in the direction different from the direction in which the movement guide extends, using elastic deformation of the movement guide.

3. The slide operation apparatus according to claim 1, wherein said movable member holding device holds the movable member so as to be displaceable in the direction different from the direction in which the movement guide extends, using the guide supporting portions that are designed to permit displacement of the opposite ends of the movement guide.

4. The slide operation apparatus according to claim 1, wherein said movable member holding device holds the movable member so as to be pivotably displaceable in a plane perpendicular to the direction in which the movement guide extends, and said stopper restricts a pivotal displacement of the predetermined portion of the movable member.

5. The slide operation apparatus according to claim 1, wherein at least one of the predetermined portion of said movable member and said stopper is provided with a resistance generating member that generates sliding resistance therebetween.

6. The slide operation apparatus according to claim 1, wherein the predetermined portion of said movable member and said stopper can be in face-contact with each other, and when said movable member is moved along said movement guide in a face-contact state therewith, friction is produced between the predetermined portion of said movable member and said stopper.

7. The slide operation apparatus according to claim 1, wherein said movement guide is flexured when applied with a force in the direction different from the direction in which said movement guide extends, and flexure of said movement guide is restored when the force is released.

8. The slide operation apparatus according to claim 1, wherein said movement guide has a magnetic pole surface thereof multipole magnetized in a longitudinal direction of said movement guide, and said position detecting device has a magnetic detecting portion thereof fixed to said movable member so as to face the magnetic pole surface of said movement guide.

9. The slide operation apparatus according to claim 1, wherein when a load ranging from several kilograms to ten kilograms is applied to said movable member in a vertical direction of said box, through said operation knob, said movement guide that holds said movable member is so deformed that the predetermined portion of said movable member is brought in contact with said stopper.

10. The slide operation apparatus according to claim 1, wherein the slide operation apparatus is used as a fader device, the predetermined portion of said movable member has first and second engagement portions apart from each other in a width direction perpendicular to the longitudinal direction and a vertical direction of said box, said stopper is made of part of a housing, which constitutes said box, of the fader device and loosely fitted between the first and second engagement portions of said movable member, and when being in contact with at least one of the first and second engagement portions, said stopper restricts movement of said movable member in the width direction of said box.

11. The slide operation apparatus according to claim 1, wherein said operation knob member includes a first portion thereof extending from said operation knob toward the movement guide in a vertical direction of the box, a second portion thereof extending from an end of the first portion in a width direction perpendicular to the longitudinal and vertical directions of said box, and a third portion thereof extending from an end of the second portion toward the predetermined portion of said movable member in the vertical direction of said box, and said operation knob member has flexibility and is formed into a crank shape.

12. The slide operation apparatus according to claim 1, wherein said stopper extends parallel to said movement guide.

* * * * *